United States Patent [19]

Alban

[11] Patent Number: 4,780,595

[45] Date of Patent: Oct. 25, 1988

[54] BODY DRYER

[76] Inventor: Richard F. Alban, 13716 Killarney Ct., Phoenix, Md. 21131

[21] Appl. No.: 90,455

[22] Filed: Aug. 28, 1987

[51] Int. Cl.[4] ..... F24H 3/04

[52] U.S. Cl. ..... 219/370; 219/363; 219/364; 219/366; 219/368

[58] Field of Search ..... 219/363, 364, 369, 370, 219/366, 367, 368

[56] References Cited

U.S. PATENT DOCUMENTS

| | | | |
|---|---|---|---|
| 2,853,552 | 9/1958 | Nee Demaret | 219/364 X |
| 3,201,548 | 8/1965 | Mertler | 219/364 X |
| 3,492,462 | 1/1970 | Schumacher | 219/370 |
| 3,547,659 | 3/1976 | Ono | 219/364 X |
| 3,939,850 | 2/1976 | Wahl | 219/368 X |
| 4,327,278 | 4/1982 | Tomaro | 219/364 |
| 4,366,368 | 12/1982 | Stephens, III | 219/370 X |
| 4,518,847 | 5/1985 | Horst, Sr. et al. | 219/364 X |

*Primary Examiner*—C. L. Albritton

*Attorney, Agent, or Firm*—Cushman, Darby & Cushman

[57] ABSTRACT

A body drying apparatus having a substantially vertical enclosure with at least one air inlet vent at one end, at least one air outlet opening along one side with vents to direct air flow or to prevent air flow through a certain section of the enclosure, a heater, a device for blowing air, and a nozzle for drying hair that does not need to be held by an operator. The portable version contains a tip switch. Two operating switches enable an operator to select one of several flow rate and temperature combinations of air. The enclosure has a shape enabling the apparatus to provide uniform air flow through the air outlet opening or openings.

37 Claims, 3 Drawing Sheets

BODY DRYER

BACKGROUND OF THE INVENTION

1. Field of Invention

This invention relates to drying apparatus, and more particularly, to apparatus for drying the body of a person.

2. Description of the Prior Art

Electric body dryers are convenient and efficient as a replacement for towel drying. For example, they reduce maintenance costs and improve unsanitary conditions associated with towel drying, particularly in locker rooms, hotels, and public washrooms. Problems of towel theft are eliminated. Body dryers used in public places can be mounted in the ceiling or on a wall to prevent vandalism and theft.

A body dryer would also be quite useful at home, particularly as a supplement to towel drying. Towel drying can be insufficient, particularly in a damp shower area, or in warm, humid weather. After a shower or bath, one is frequently left with a damp, sticky feeling which can be eliminated with a body dryer.

The need for body dryers is demonstrated in the art such as through U.S. Pat. Nos. 2,977,455, 3,128,161, 3,449,838, 3,621,199, 3,711,958, 3,878,621, 4,558,526, and 4,594,797. The use of portable body dryers is contemplated by U.S. Pat. No. 4,594,797, in which the means for supplying air is located near the top end of the dryer. Inclusion of a hand-held hose or other air duct adapted for drying hair is disclosed in U.S. Pat. Nos. 3,128,161, 3,878,621, and 4,594,797. However, none of the prior art suggests the desirability of incorporating a stationary nozzle on the dryer to facilitate hair drying or the like while allowing the operator's hands to be free.

SUMMARY OF THE INVENTION

This invention overcomes the problems with towel drying and with other body dryers by providing a body dryer having a lightweight, vertical enclosure which includes a nozzle mounted on the enclosure suitable for use as a hair dryer, for example. The enclosure includes at least one air inlet vent and houses a heater and a blower. Outlet vents are arranged substantially vertically for full body drying. Adjustable vents may be used to direct air at desired angles. Selected sections of the adjustable vents may be closed while other sections remain open. The hair drying nozzle may be rotated manually from the operating position to a position in which air flow through the nozzle is prevented. The drying nozzle does not need to be hand-held, and thus the operator of the dryer may hold a towel, or have the use of his or her hands.

In one preferred embodiment, the heater and blower may be mounted at the bottom of the dryer, providing improved stability for the portable, freestanding version. A safety feature of the portable embodiment may be a tip switch that will automatically turn off the dryer if it becomes unstable. The orientation of the heating and blowing means will affect the center of gravity of a portable, vertical dryer and thus may affect its stability. Placement of the heating and blowing means at the top, as in the prior art, would require the addition of weight and breadth at the base of the apparatus. Use of the hand-held hose as in the prior art can cause problems with the stability and operation of a portable dryer because an operator may attempt to extend the hose too far, upsetting the balance of the dryer or damaging the hose.

Typical known body dryers do not actuate heating elements prior to actuation of the fan. The present inventor has realized that body dryers in which no preheating occurs may result in discomfort to the user before the air is heated. The loss of heat resulting from the vaporization of water during the initial operating time of a body dryer can produce a cold sensation analogous to the feeling a swimmer experiences after stepping out of the water on a windy day. To overcome this problem, the dryer of the present invention may be equipped with a time delay device that may be used to preheat the heater before air is blown, eliminating the discomfort felt during the initial use of other body dryers.

The dryer may be operated by two, switches to provide either (1) hot, high-speed air flow; (2) warm, less powerful air flow; or (3) unheated, highspeed air flow. The apparatus may further include a ground fault detector and a temperature detector that will turn off the dryer if it overheats.

BRIEF DESCRIPTION OF THE DRAWINGS

These and other objects and advantages of this invention will become more apparent and more readily appreciated from the following detailed description of the presently preferred exemplary embodiment, taken in conjunction with the accompanying drawings, of which.

DETAILED DESCRIPTION OF THE PRESENTLY PREFERRED EXEMPLARY EMBODIMENT

Figure 1:
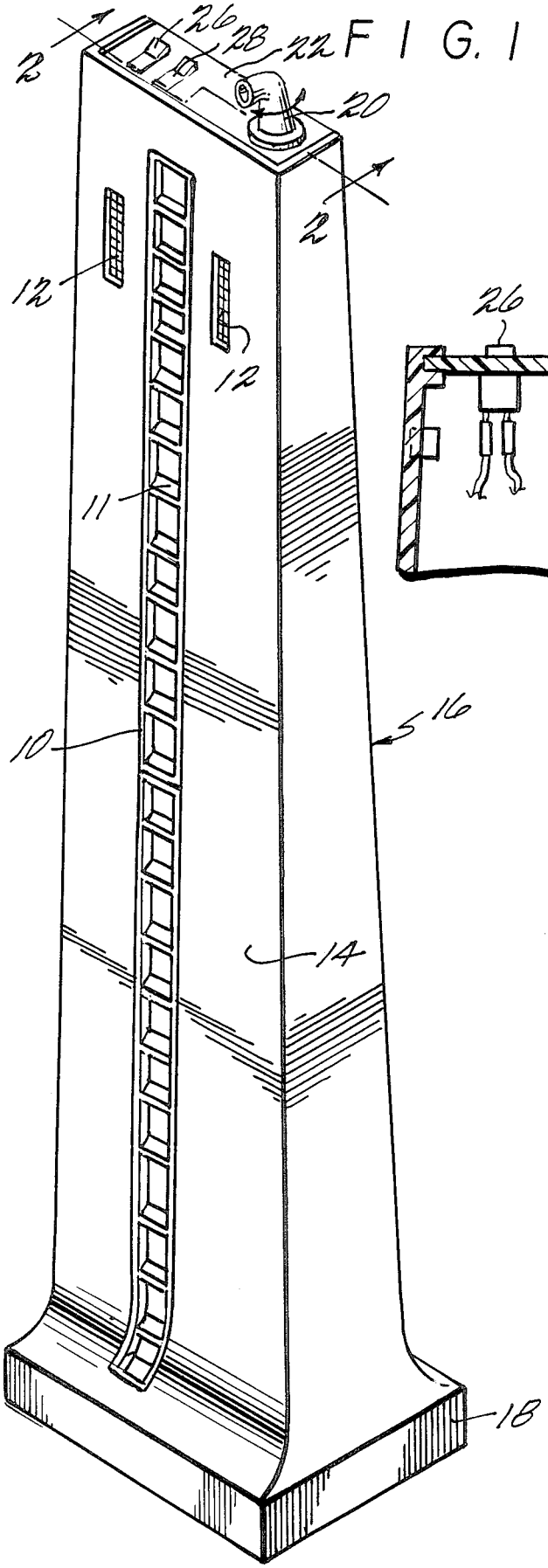
FIG. 1 is a perspective view of a portable full body dryer in accordance with this invention.

FIG. 1 shows a perspective view of a preferred embodiment for a portable body dryer in accordance with this invention. Adjustable vents 10 with louvres 11 and fixed vents 12 provide outward air flow through front 14 of tapered vertical enclosure 16. Louvres 11 are shown directing outlet air downward, but can be adjusted to direct air in other directions. When louvres 11 are placed in a substantially vertical position, air flow through vents 10 is prevented. Base 18 supports vertical enclosure 16, permitting the dryer to be freestanding and portable. Rotatable nozzle 20 located on top panel 22 of vertical enclosure 16 allows for outward flow of air when opening 24 of nozzle 20 aims air in the same general direction as air from fixed vents 12. Operating switches 26 and 28 control the air flow rate and air temperature, as well as the preheat device and automatic timer, schematically shown in more detail in FIG. 5.

Figure 2:
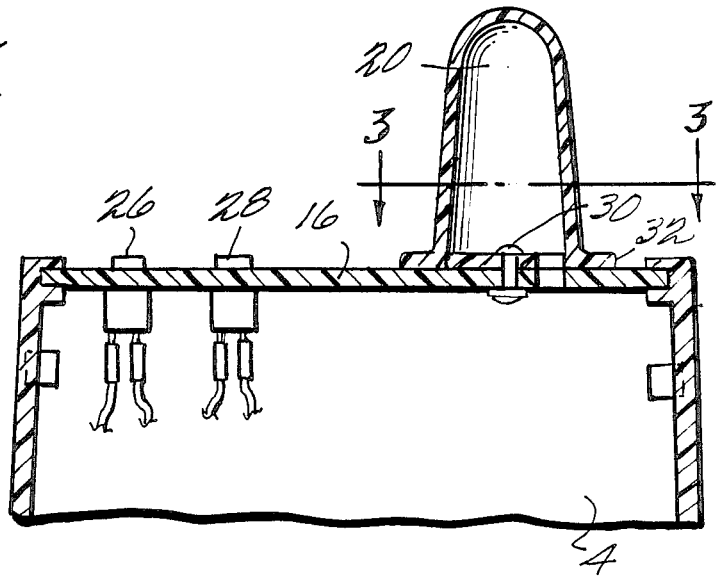
FIG. 2 is a section taken along the 2—2 line of FIG. 1.
Figure 3:
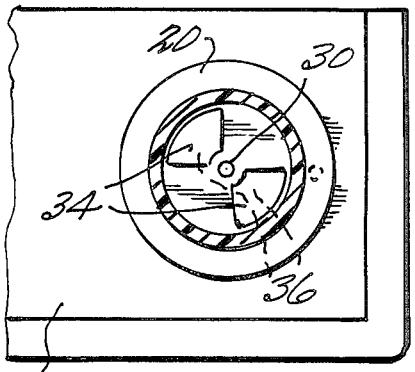
FIG. 3 is a section taken along the 3—3 line of FIG. 2.

In FIG. 2, screw 30 rotatably attaches base 32 of rotatable nozzle 22 to top panel 22 of vertical enclosure 16. As can best be seen in FIG. 3, openings 34 are provided in opposite quarter sections of base 32 of nozzle 22. Corresponding openings 36 are provided in opposite quarter sections of a circular region on top panel 22. When nozzle 22 is turned to blow air in the same general direction as air from vents 10 and 12, openings 34 align with openings 36, allowing air from enclosure 16 to escape through nozzle 20. The air flow may be stopped when nozzle 20 is rotated ninety degrees clockwise or counterclockwise away from the position in which openings 34 and 36 are superimposed.

Figure 4:
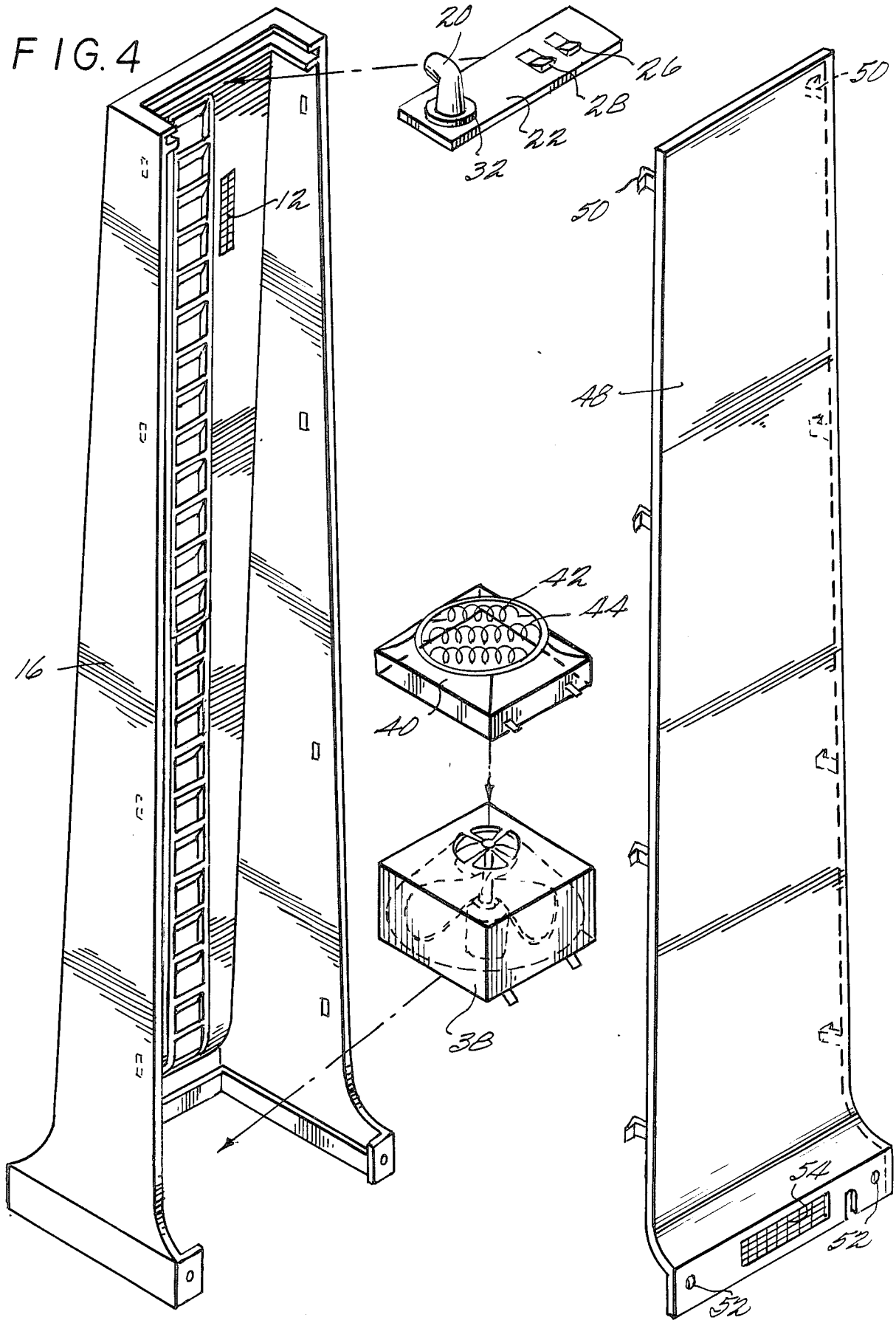
FIG. 4 is an exploded perspective of the body dryer of FIG. 1.

As illustrated in FIG. 4, top panel 22 slides into an upper end of vertical enclosure 16 from the back. Motorized fan 38 may be fastened into a lower end of vertical enclosure 16. Heating unit 40, containing heating coils 42 and 44, may be placed directly above fan 38. Back panel 48 of vertical enclosure 16 may be fastened to vertical enclosure 16 by clips 50 and screws 52. Inlet vent 54 allows air to enter vertical enclosure 16. By mounting heating unit 40 and fan 38 low in enclosure 16, stability is enhanced, particularly when enclosure 16 is free standing.

Figure 5:
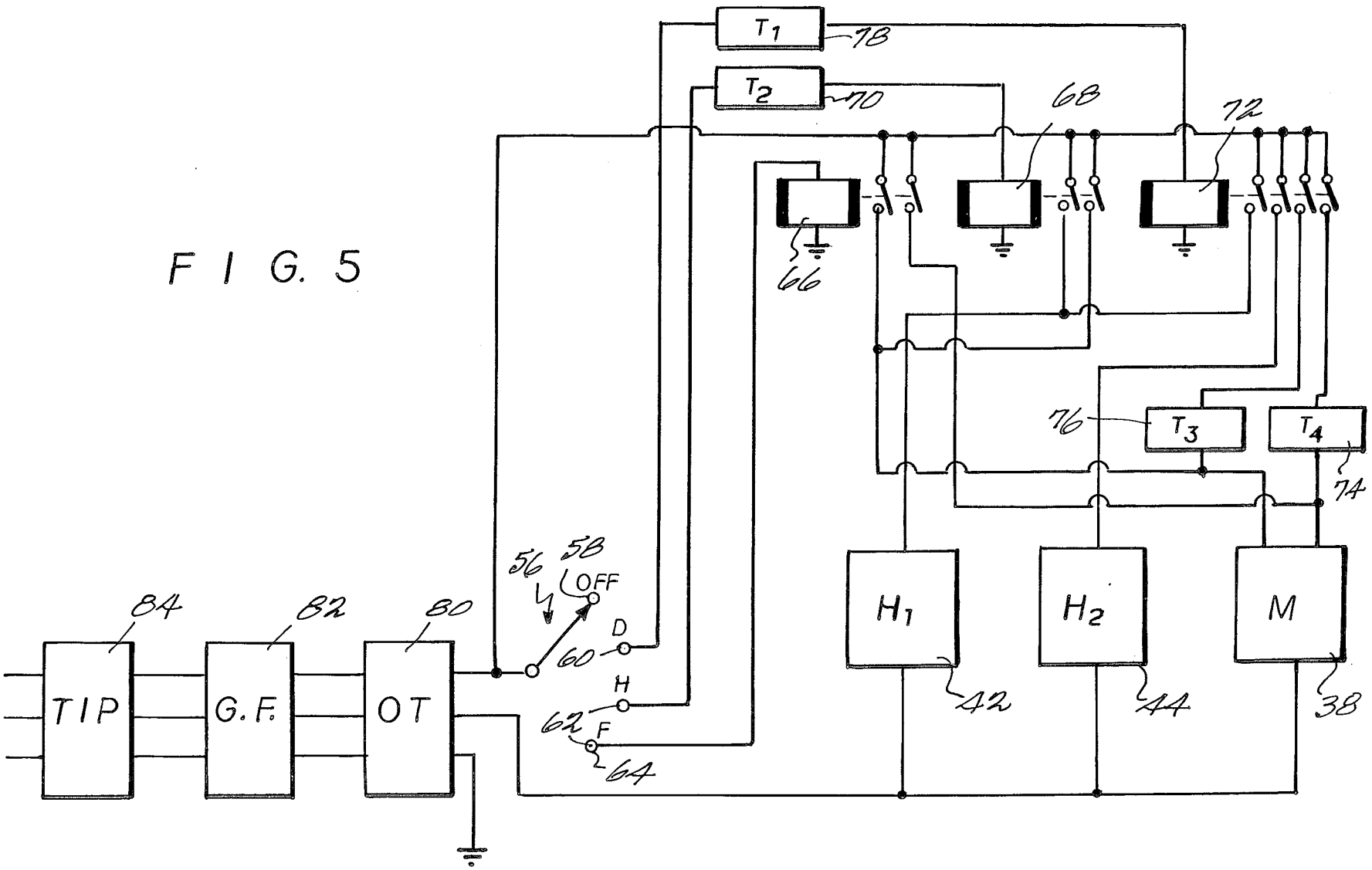
FIG. 5 is a block diagram of the electrical system in the preferred embodiment.

FIG. 5 schematically illustrates the circuitry of the preferred embodiment which allows it to operate at different heats and air flow rates. The four possible combinations of positions for operating switches 26 and 28 shown in FIG. 1 are represented by schematic switch 56 having four terminals 58, 60, 62 and 64. Those skilled in the art will readily appreciate that logic circuits may be used to convert signals sent from operating switches 26 and 28 to operate schematic switch 56.

When operating switches 26 and 28 are both in the downward position relative to the front 14 of vertical enclosure 16 (the position shown in FIG. 1), schematic switch 56 is in position 58, the "off" position.

When operating switch 26 is moved to the upward position and operating switch 28 remains in the downward position, schematic switch 56 in FIG. 5 moves to position 64, the "fan" position. This causes relay 66 to energize fan 38 to the higher of two speeds.

When operating switch 26 is in the downward position and operating switch 28 is in the upward position, schematic switch 56 in FIG. 5 moves to position 62, the "heat" position. As a result, relay 68 causes heating coil 42 to energize, and causes fan 38 to operate at low speed. Timer 70 turns off fan 38 and heating coil 42 after five minutes.

When operating switches 26 and 28 are both in the upward position, schematic switch 56 moves to position 60, the "dry" position. The resultant energization of relay 72 causes heating coils 42 and 44 to energize. Time delays 74 and 76 cause a delay of fifteen seconds before fan 38 is energized to a high speed. Timer 78 turns off fan 38 and heating coils 42 and 44 after three minutes.

Schematic switch 56 may receive power through an overheat detector 80, ground fault detector 82 and tip switch 84 in a conventional 35 manner.

Although only a single exemplary embodiment has been described in detail above, those skilled in the art will readily appreciate that many modifications are possible in the preferred embodiment without materially departing from the novel teachings and advantages of this invention. For example, the invention may be mounted on a wall or ceiling, or affixed to the floor. The electrical system described in the preferred embodiment is not intended to limit the scope of the claimed invention. The vertical enclosure may be comprised of extruded or molded high heat and impact resistant plastic.

Accordingly all such modifications are intended to be included within the scope of this invention as defined by the following claims.

What is claimed is:

1. Apparatus for drying substantially the full length of a human subject comprising:

a base;

an elongated enclosure held by said base in a vertical position when said base is resting on a floor, said enclosure extending substantially the full length of said human subject and having at least one inlet vent and at least one outlet opening extending along a substantial portion of the length of said enclosure to enable drying of the full length of said human subject with air emitted from said outlet opening;

means, disposed in said enclosure, for blowing air from said at least one inlet vent out said at least one outlet opening;

means, disposed in said enclosure, for heating air passing from said at least one inlet vent to said at least one outlet opening; and a nozzle rotatably mounted on an end of said enclosure opposite said base so as to be directable at the head of said human subject, said nozzle including means for allowing air flow through said nozzle when said nozzle is directed toward said human subject and preventing air flow through said nozzle when said nozzle is directed away from said human subject, said blowing means blowing air from said outlet opening independent of the positioning of said nozzle.

2. Apparatus according to claim 1 further comprising means for manually deactuating said heating means and said blowing means, and means for automatically deactuating said heating means and said blowing means a predetermined time after actuation.

3. Apparatus according to claim 2 further comprising preheat means for preventing said blowing means from being energized until after said heating means has been energized, so that said blowing means does not cause cold air to be blown from said outlet opening.

4. Apparatus according to claim 1 wherein said blowing means comprises a two-speed fan and said heating means comprises a dual wattage heater.

5. Apparatus according to claim 4 further comprising control means, coupled to said heating means and said blowing means, for selectively providing any of the following three combinations of heat and air flow output: (1) high heat and high air flow; (2) low heat and low air flow; and (3) unheated, high air flow.

6. Apparatus according to claim 5 further comprising means for automatically deactuating said heating means and said blowing means a predetermined time after actuation.

7. Apparatus according to claim 6 further comprising preheat means for preventing said blowing means from being energized until after said heating means has been energized so that said blowing means does not cause cold air to be blown from said outlet opening.

8. Apparatus according to claim 1 further comprising adjustable vent units, mounted in said at least one outlet opening, for directing air flow at desired angles and for selectively preventing said air flow through sections of said at least one outlet opening.

9. Apparatus according to claim 1 wherein said at least one inlet vent is positioned proximate a lower end of said enclosure.

10. Apparatus according to claim 9 wherein said blowing means is positioned proximate said at least one inlet vent.

11. Apparatus according to claim 10 wherein said heating means is positioned proximate said at least one inlet vent.

12. Apparatus according to claim 1 wherein said enclosure tapers generally inward from a lower end to an opposite end and said outlet opening extends along said taper.

13. Apparatus according to claim 1 wherein said apparatus is portable, and said base is adapted to be movably positioned on a surface.

14. Apparatus according to claim 13 further comprising means for turning off and preventing energization of said heating means and said blowing means when said enclosure is not stably and vertically positioned on a surface.

15. A portable apparatus for drying substantially the full length of a human subject comprising:

a portable base adapted to be movably positioned on a floor;

an elongated enclosure held by said base in a vertical position when said base is resting on a floor, said enclosure extending substantially the full length of said human subject and having at least one inlet vent proximate a lower end of said enclosure and at least one outlet opening extending along a substantial portion of the length of said enclosure to enable drying of the full length of said human subject with air emitted from said outlet opening;

means, disposed in said enclosure proximate said at least one inlet vent, for blowing air from said inlet vent out said at least one outlet opening; and means, disposed in said enclosure proximate said at least one inlet vent, for heating air passing from said at least one inlet vent to said at least one outlet opening.

16. Apparatus according to claim 15 further comprising manually deactuating said heating means and said blowing means, and means for automatically deactuating said heating means and said blowing means a predetermined time after actuation.

17. Apparatus according to claim 16 further comprising preheat means for preventing said blowing means from being energized until after said heating means has been energized, so that said blowing means does not cause cold air to be blown from said outlet opening.

18. Apparatus according to claim 15 wherein said blowing means comprises a two-speed fan and said heating means comprises a dual wattage heater.

19. Apparatus according to claim 18 further comprising control means, coupled to said heating means and said blowing means, for selectively providing the following three combinations of heat and air flow output: (1) high heat and high air flow; (2) low heat and low air flow; and (3) unheated, high air flow.

20. Apparatus according to claim 19 further comprising means for automatically deactuating said heating means and said blowing means a predetermined time after actuation.

21. Apparatus according to claim 20 further comprising preheat means for preventing said blowing means from being energized until after said heating means has been energized, so that said blowing means does not cause cold air to be blown from said outlet opening.

22. Apparatus according to claim 15 further comprising adjustable vent units, mounted in said at least one outlet opening, for directing air flow at desired angles and for selectively preventing said air flow through sections of said at least one outlet opening.

23. Apparatus according to claim 15 wherein said enclosure tapers generally inward from a lower end to an opposite end.

24. Apparatus according to claim 23 further comprising means for turning off and preventing energization of said heating means and said blowing means when said enclosure is not stably and vertically positioned on a surface.

25. Apparatus according to claim 15 further comprising a nozzle rotatably mounted on an end of said enclosure opposite said base so as to be directable at the head of said human subject, said nozzle including means for allowing air flow through said nozzle when said nozzle is directed toward said human subject and preventing air flow through said nozzle when said nozzle is directed away from said human subject, said blowing means blowing air from said outlet opening independent of the position of said nozzle.

26. Apparatus for drying substantially the full length if a human subject comprising:

a base;

an elongated enclosure held by said base in a vertical position when said base is resting on a floor, said enclosure extending substantially the full length of said human subject and having at least one inlet vent and at least one outlet opening extending along a substantial portion of the length of said enclosure to enable drying of the full length of said human subject with air emitted from said outlet opening;

means, disposed in said enclosure, for blowing air from said at least one inlet vent out said at least one outlet opening;

means, disposed in said enclosure, for heating air passing from said at least one inlet vent to said at least one outlet opening; and preheat means for preventing said blowing means from being energized until said heating means has been energized, so that said blowing means does not cause cold air to be blow from said outlet opening.

27. Apparatus according to claim 26 further comprising means for manually deactuating said heating means and said blowing means, and means for automatically deactuating said heating means and said blowing means a predetermined time after actuation.

28. Apparatus according to claim 26 wherein said blowing means comprises a two-speed fan and said heating means comprises a dual wattage heater.

29. Apparatus according to claim 28 further comprising control means, coupled to said heating means and said blowing means, for selectively providing the following three combinations of heat and air flow output: (1) high heat and high air flow; (2) low heat and low air flow; and (3) unheated, high air flow.

30. Apparatus according to claim 29 further comprising means for automatically deactuating said heating means and said blowing means a predetermined time after actuation.

31. Apparatus according to claim 26 further comprising adjustable vent units, mounted in said at least one outlet opening, for directing air flow at desired angles and for selectively preventing said air flow through sections of said at least one outlet opening.

32. Apparatus according to claim 26 wherein said at least one inlet vent is positioned proximate a lower end of said enclosure.

33. Apparatus according to claim 32 wherein said blowing means is positioned proximate said at least one inlet vent.

34. Apparatus according to claim 33 wherein said heating means is positioned proximate said at least one inlet vent.

35. Apparatus according to claim 26 wherein said enclosure tapers generally inward from a lower end to an opposite end.

36. Apparatus according to claim 26. wherein said apparatus is portable, said base being adapted to be movably positioned on a surface.

37. Apparatus according to claim 36 further comprising means for turning off and preventing energization of said heating means and said blowing means when said enclosure is not stably and vertically positioned on a surface.

* * * * *